US008935999B2

(12) United States Patent
Nakashima

(10) Patent No.: US 8,935,999 B2
(45) Date of Patent: Jan. 20, 2015

(54) CONTROL DEVICE FOR INTERNAL COMBUSTION ENGINE

(75) Inventor: Toyokazu Nakashima, Mie-ken (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 13/580,530

(22) PCT Filed: Nov. 10, 2011

(86) PCT No.: PCT/JP2011/075972

§ 371 (c)(1),
(2), (4) Date: Aug. 22, 2012

(87) PCT Pub. No.: WO2013/069137

PCT Pub. Date: May 16, 2013

(65) Prior Publication Data

US 2014/0230762 A1 Aug. 21, 2014

(51) Int. Cl.

| | |
|---|---|
| ***F01L 1/34*** | (2006.01) |
| ***F01L 9/02*** | (2006.01) |
| ***F01L 1/344*** | (2006.01) |
| *F01L 1/18* | (2006.01) |
| *F01L 1/24* | (2006.01) |
| *F01L 1/053* | (2006.01) |

(52) U.S. Cl.

CPC ..... *F01L 9/02* (2013.01); *F01L 1/3442* (2013.01); *F01L 2001/34453* (2013.01); *F01L 2001/34466* (2013.01); *F01L 2001/34469* (2013.01); *F01L 2001/34476* (2013.01); *F01L 1/185* (2013.01); *F01L 1/24* (2013.01); *F01L 2001/0537* (2013.01); *F01L 2105/00* (2013.01); *F01L 2250/02* (2013.01); *F01L 2800/01* (2013.01)

USPC ..... 123/90.15; 123/90.17; 464/160

(58) Field of Classification Search

USPC ..... 123/90.15, 90.17; 464/160

See application file for complete search history.

(56) References Cited

U.S. PATENT DOCUMENTS

| | | | | |
|---|---|---|---|---|
| 8,210,142 | B2 * | 7/2012 | Suzuki et al. | 123/90.17 |
| 2006/0207537 | A1 | 9/2006 | Nakajima et al. | |

FOREIGN PATENT DOCUMENTS

| | | |
|---|---|---|
| JP | 51-123444 | 10/1976 |
| JP | 8-113140 | 5/1996 |
| JP | 11-210424 | 8/1999 |
| JP | 2001-41012 | 2/2001 |
| JP | 2002-70681 | 3/2002 |
| JP | 2002-122009 | 4/2002 |
| JP | 2005-299409 | 10/2005 |
| JP | 2006-291944 | 10/2006 |
| JP | 2010-24985 | 2/2010 |
| JP | 2010-112337 | 5/2010 |
| JP | 2012-149591 | 8/2012 |
| WO | WO 2012/098657 A1 | 7/2012 |

* cited by examiner

*Primary Examiner* — Ching Chang

(74) *Attorney, Agent, or Firm* — Finnegan, Henderson, Farabow, Garrett & Dunner, LLP

(57) ABSTRACT

An electronic control device for controlling an internal combustion engine reduces operation amounts of a high-pressure fuel pump and a vacuum pump, which are auxiliary devices driven by drive force of an intake camshaft, when a rotor of a variable valve timing mechanism is rotated to a lock phase in the phase advancing direction at the engine starting. Thus, the rotor rotates to the lock phase quickly and is fixed to the lock phase.

9 Claims, 6 Drawing Sheets

CONTROL DEVICE FOR INTERNAL COMBUSTION ENGINE

CROSS-REFERENCE TO RELATED APPLICATIONS

This application is a national phase application of International Application No. PCT/JP2011/075972, filed Nov. 10, 2011, the content of which is incorporated herein by reference.

FIELD OF THE INVENTION

The present invention relates to a control device for an internal combustion engine provided with a hydraulically-driven variable valve timing mechanism.

BACKGROUND OF THE INVENTION

As a mechanism for changing valve timing of an internal combustion engine, a hydraulically-driven variable valve timing mechanism is known. In the hydraulically-driven variable valve timing mechanism, a rotor fixed to a distal end of a camshaft is accommodated in a housing fixed to a sprocket. A plurality of vanes protruding in the radial direction are provided in this rotor. On the other hand, accommodation chambers accommodating these vanes, respectively, are provided in the housing. As a result, each accommodation chamber is divided into a phase advancing hydraulic chamber and a phase retarding hydraulic chamber by the vane.

In the internal combustion engine provided with the variable valve timing mechanism configured as above, the rotor is rotated in the housing by adjusting a hydraulic pressure in the phase advancing hydraulic chamber and the phase retarding hydraulic chamber to change relative rotational phases of the rotor and the camshafts with respect to the sprocket. As a result, valve timing of the intake valve or the exhaust valve is changed.

In order to realize the valve timing suitable for engine starting, the relative rotational phases of the rotor and the camshaft with respect to the sprocket need to be fixed to relative rotational phases suitable for the engine starting. However, since a stable hydraulic pressure cannot be ensured at the engine starting, it is difficult to hold the relative rotational phase of the rotor with respect to the sprocket by the hydraulic pressures in the phase advancing hydraulic chamber and the phase retarding hydraulic chamber. Thus, a lock mechanism for holding the relative rotational phase of the rotor with respect to the sprocket to a lock phase, which is a relative rotational phase suitable for the engine starting is provided. When the internal combustion engine is stopped, the rotor is fixed to the lock phase by the lock mechanism. The lock mechanism includes a lock pin and a lock hole engaged with the lock pin and restricts the relative rotation motion of the rotor with respect to the sprocket by inserting the lock pin into the lock hole.

At the engine starting, the rotor is preferably fixed to the lock phase by the lock mechanism, but if the rotor cannot be fixed to the lock phase when the engine is stopped, the rotor might not be fixed to the lock phase when the engine is started. In such a case, since the valve timing at the engine starting becomes unstable, the engine starting might not be able to be completed or it might take time to start the engine.

In order to cope with the above, however, in an internal combustion engine described in Patent Document 1, if the rotor is not fixed to the lock phase at the engine starting, the hydraulic pressure is used to rotate the rotor to the lock phase to fix the rotor to the lock phase by the lock mechanism.

Moreover, in an internal combustion engine described in Patent Document 2, a plurality of stepped portions with different depths are provided on the bottom face of the lock hole, and these stepped portions are arranged so that the depths thereof become gradually deeper toward the lock phase. If the camshaft rotates, a positive torque for rotating the rotor and the camshaft in a direction to retard the valve timing and a negative torque for rotating the rotor and the camshaft in a direction to advance the valve timing alternately act on the rotor and the camshaft with opening/closing of the valve by a cam. If the positive torque and the negative torque act on the rotor and the camshaft at the engine starting when the hydraulic pressures in the phase advancing hydraulic chamber and the phase retarding hydraulic chamber have not sufficiently risen, the rotor rotates alternately in the phase advancing direction and the phase retarding direction in the housing. If the rotor rotates in the housing as above, the lock pin sequentially fits in the plurality of stepped portions with different depths provided on the lock hole in the lock mechanism, whereby the rotor gradually rotates toward the lock phase, and finally, the rotor reaches the lock phase where the rotor is fixed by the lock mechanism. That is, in the internal combustion engine described in Patent Document 2, the lock mechanism is provided with a ratchet mechanism, and the rotor is rotated to the lock phase at the engine starting by the action of this ratchet function.

PRIOR ART DOCUMENT

Patent Document

Patent Document 1: Japanese Laid-Open Patent Publication No. 2001-41012

Patent Document 2: Japanese Laid-Open Patent Publication No. 2002-122009

SUMMARY OF THE INVENTION

However, even if the rotor is rotated to the lock phase at the engine starting by rotating the rotor by the hydraulic pressure as described in Patent Document 1 or by rotating the rotor by using the ratchet function as described in Patent Document 2, the rotor might not be able to be rotated to the lock phase quickly in some cases.

At the engine starting, for example, a stable hydraulic pressure cannot be ensured. Thus, even if the rotor is to be rotated by using the hydraulic pressure as described in Patent Document 1, it might take a long time for the rotor to reach the lock phase and to be fixed by the lock mechanism.

Moreover, if the rotor is rotated to the lock phase by using the positive torque and the negative torque by providing the lock mechanism having the ratchet function as described in Patent Document 2, a rotation amount of the rotor generated when the positive torque and the negative torque act becomes small when the temperature of hydraulic oil is low and the viscosity of the hydraulic oil is high. As a result, it becomes difficult to fix the rotor by the lock mechanism by rotating the rotor to the lock phase during cranking.

An objective of the present invention is to provide a control device for an internal combustion engine that can rotate the rotor to the lock phase quickly to fix the rotor at the lock phase by the lock mechanism and to complete the engine starting at an early stage even if the rotor is not fixed by the lock mechanism at the engine starting.

To achieve the foregoing objective and in accordance with one aspect of the present invention, a control device for an internal combustion engine is provided that includes a hydraulically driven variable valve timing mechanism, a lock mechanism, and an auxiliary device. The hydraulically-driven variable valve timing mechanism has a housing rotating in conjunction with rotation of a crankshaft and a rotor connected to a camshaft and changes valve timing by changing a relative rotational phase of the rotor with respect to the housing by using a hydraulic pressure. The lock mechanism fixes the relative rotational phase of the rotor with respect to the housing to a locked phase by inserting a lock pin into a lock hole. The auxiliary device is driven by drive force of the camshaft. If the rotor is not fixed by the lock mechanism at the engine starting, the rotor is rotated to the lock phase in the phase advancing direction and the rotor is fixed by the lock mechanism. An operation amount of the auxiliary device is reduced when the rotor is rotated to the lock phase in the phase advancing direction at the engine starting.

If the auxiliary device is driven by the drive force of the camshaft, the higher an operation amount of the auxiliary device, the larger an acting load becomes when the camshaft is rotated. Thus, the higher the operation amount of the auxiliary device, the more difficult it becomes for the camshaft and the rotor to rotate in the phase advancing direction.

According to the above described configuration, when the rotor is rotated to the lock phase in the phase advancing direction, the operation amount of the auxiliary device driven by the drive force of the camshaft is reduced. Thus, the rotor is easily rotated in the phase advancing direction. Therefore, even if the rotor is not fixed by the lock mechanism at the engine starting, the rotor can be rotated quickly to the lock phase to fix the rotor to the lock phase by the lock mechanism. As a result, the engine starting is completed at an early stage.

In accordance with one aspect of the present invention, a plurality of stepped portions having different depths are arranged on a bottom face of the lock hole such that the depths become deeper toward the lock phase. The lock mechanism is provided with a ratchet function such that when the rotor rotates in the housing, the rotor is rotated toward the lock phase in the phase advancing direction by sequentially fitting the lock pin in the stepped portions.

According to the above described configuration, when the rotor rotates in the housing at opening/closing of the valve with the rotation of the camshaft at the engine starting by the action of the ratchet function, the rotor is rotated in the phase advancing direction toward the lock phase. Since the operation amount of the auxiliary device is reduced at this time, the rotor can be rotated more easily in the phase advancing direction when the rotor turns in the housing. Therefore, even if the oil temperature is low and the viscosity of the hydraulic oil is high, a decrease of the rotation amount in the phase advancing direction can be suppressed. Thus, even if the oil temperature is low and the viscosity of the hydraulic oil is high, the rotor can be rotated to the lock phase quickly to fix the rotor to the lock phase by the lock mechanism, and the engine starting is completed at an early stage.

In accordance with one aspect of the present invention, the control device rotates the rotor to the lock phase in the phase advancing direction by using a hydraulic pressure.

According to the above described embodiment, the rotor is rotated toward the lock phase in the phase advancing direction by the hydraulic pressure. At this time, since the operation amount of the auxiliary device is reduced, the rotor is rotated in the phase advancing direction even with a low hydraulic pressure. Therefore, even at the engine starting when a stable hydraulic pressure cannot be easily ensured, the rotor can be rotated to the lock phase quickly to fix the rotor to the lock phase by the lock mechanism, and the engine starting is completed at an early stage.

In the internal combustion engine provided with the lock mechanism having the ratchet function, a configuration in which the rotor is rotated to the lock phase in the phase advancing direction by the hydraulic pressure at the engine starting may be employed so that the rotor is rotated to the lock phase by using both actions by the ratchet function and the action of the hydraulic pressure.

In accordance with one aspect of the present invention, the internal combustion engine is mounted on a vehicle provided with a brake operating member operated by a driver, a brake booster assisting the operation of the brake operating member by using a negative pressure, and a parking brake. The auxiliary device includes a vacuum pump for supplying a negative pressure to the brake booster. The control device reduces the operation amount of the vacuum pump on condition that the parking brake is operating.

If the operation amount of the vacuum pump supplying a negative pressure to the brake booster is reduced, a function of the brake booster for reducing power required for an operation of a brake operating member is decreased.

On the other hand, if a parking brake is operating, even if the car is stopped and the function of the brake booster is decreased, it can be estimated that the stop state can be maintained.

Thus, if the operation amount of the vacuum pump is to be reduced, it is preferable that the operation amount of the vacuum pump be reduced on condition that the parking brake is operating. By employing such a configuration, even on a slope, the operation amount of the vacuum pump can be reduced and the engine starting is completed at an early stage while the stop state is maintained.

As a specific configuration for reducing the operation amount of the vacuum pump, a configuration can be employed in which a clutch that can disconnect the vacuum pump and the camshaft from each other is provided, and i the vacuum pump and the camshaft are disconnected from each other by the clutch to stop operation of the vacuum pump.

Moreover, as a specific configuration for reducing the operation amount of the vacuum pump, a configuration in which a relief valve for opening a negative-pressure supply passage to which the vacuum pump is connected to the atmosphere is provided, and in which the relief valve is opened to open the negative-pressure supply passage to the atmosphere can be also employed.

In accordance with one aspect of the present invention, the auxiliary device includes a high-pressure fuel pump. The control device reduces an operation amount of the high-pressure fuel pump on condition that a state where a rotation speed of the crankshaft does not rise with the engine starting to a level at which completion of the engine starting is determined has continued.

If an operation amount of the high-pressure fuel pump is reduced, there is a concern that a fuel pressure for appropriate fuel injection cannot be ensured.

On the other hand, if a state where a rotation speed of the crankshaft does not rise to a level at which completion of the engine starting is determined continues, it is estimated that the engine starting cannot be completed even if fuel is injected.

Thus, if the operation amount of the high-pressure fuel pump is to be reduced, it is preferable that the operation amount of the high-pressure fuel pump be reduced on condition that the state where the rotation speed of the crankshaft does not rise with the engine starting to the level at which completion of the engine starting is determined continues. By employing this configuration, such a situation can be suppressed that the operation amount of the high-pressure fuel pump is reduced in the state where the engine starting is completed without reducing the operation amount of the high-pressure fuel pump and as a result, taking longer to start the engine.

In the high-pressure fuel pump configured such that the amount of fuel pressure-fed by controlling timing to open a spill valve is changed, the fuel can no longer be pressure-fed by the high-pressure fuel pump by holding the spill valve in an open state, and thus, the operation amount can be reduced.

Thus, as a specific method for reducing the operation amount of the high-pressure fuel pump as above, a method of holding the spill valve in the open state can be employed.

Moreover, as a configuration for reducing the operation amount of the high-pressure fuel pump, a configuration can also be employed in which a clutch capable of disconnecting the high-pressure fuel pump and the camshaft from each other is provided, and in which the high-pressure fuel pump and the camshaft are disconnected by the clutch to stop operation of the high-pressure fuel pump.

DETAILED DESCRIPTION OF THE PREFERRED EMBODIMENTS

A control device for an internal combustion engine according to one embodiment of the present invention will be described below by referring to FIGS. 1 to 5.

Figure 1:
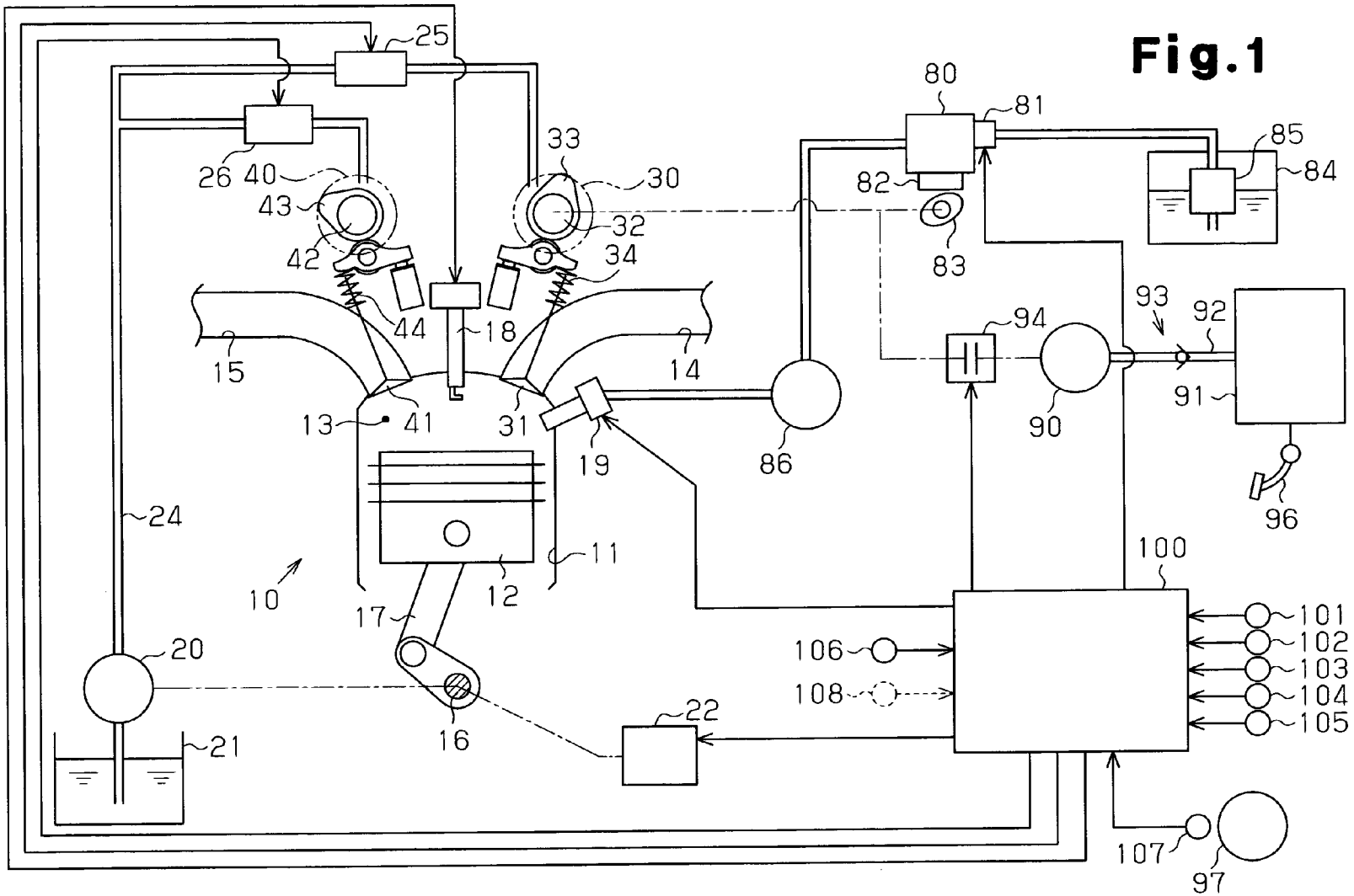
FIG. 1 is a schematic diagram of a control device for an internal combustion engine according to one embodiment of the present invention and the internal combustion engine to be controlled.

As illustrated in FIG. 1, in a cylinder 11 of an internal combustion engine 10, a piston 12 is accommodated to be capable of reciprocal motion. A combustion chamber 13 is defined by a top surface of the piston 12 and an inner peripheral surface of the cylinder 11. An ignition plug 18 is mounted on an upper part of the combustion chamber 13. Moreover, a fuel injection valve 19 for directly injecting fuel into the combustion chamber 13 is provided in the combustion chamber 13. Further, an intake passage 14 for introducing air into the combustion chamber 13 and an exhaust passage 15 for discharging exhaust from the combustion chamber 13 are connected to the combustion chamber 13.

A crankshaft 16 for converting a reciprocal motion of the piston 12 to a rotary motion is connected to the piston 12 through a connecting rod 17. Moreover, an intake camshaft 32 for opening/closing an intake valve 31 and an exhaust camshaft 42 for opening/closing an exhaust valve 41 are rotationally accommodated in an upper part of the internal combustion engine 10. A variable valve timing mechanism 30 for changing valve timing of the intake valve 31 is attached to a distal end of the intake camshaft 32, and a variable valve timing mechanism 40 for changing valve timing of the exhaust valve 41 is attached to a distal end of the exhaust camshaft 42. The variable valve timing mechanisms 30 and 40 are connected to the crankshaft 16 through a timing chain. As a result, when the crankshaft 16 is rotated, the rotation is transmitted to the variable valve timing mechanisms 30 and 40 through the timing chain, and the intake camshaft 32 and the exhaust camshaft 42 are rotated, respectively.

The intake valve 31 is urged by a valve spring 34 to a valve closing direction. When the intake camshaft 32 is rotated, the intake valve 31 is displaced against urging force of the valve spring 34 by an action of an intake cam 33 provided on the intake camshaft 32, thereby opening the intake valve 31.

The exhaust valve 41 is urged by a valve spring 44 to the valve closing direction. When the exhaust camshaft 42 is rotated, the exhaust valve 41 is displaced against the urging force of the valve spring 44 by an action of an exhaust cam 43 provided on the exhaust camshaft 42, and the exhaust valve 41 is opened.

An oil pan 21 for storing hydraulic oil and an oil pump 20 driven by drive force of the crankshaft 16 and pumping up the hydraulic oil in the oil pan 21 are provided on a lower part of the internal combustion engine 10. The hydraulic oil pumped up by this oil pump 20 is supplied to the variable valve timing mechanisms 30 and 40 through an hydraulic oil passage 24. In the hydraulic oil passage 24, control valves 25 and 26 for controlling supply of the hydraulic oil to hydraulic chambers and discharge of the hydraulic oil from the hydraulic chambers of the variable valve timing mechanisms 30 and 40 are provided.

The hydraulic oil stored in the oil pan 21 is partly supplied to the variable valve timing mechanisms 30 and 40 and functions as the hydraulic oil for generating a hydraulic pressure for driving the variable valve timing mechanisms 30 and 40 and also functions as lubricant oil supplied to each part of the internal combustion engine 10 and lubricating each part in the internal combustion engine 10.

A starter motor 22 for forcedly rotating and cranking the crankshaft 16 at start of the internal combustion engine 10 is connected to the crankshaft 16.

As illustrated at the center in FIG. 1, a fuel injection valve 19 is connected to a delivery pipe 86 storing a high-pressure fuel. The fuel stored in a fuel tank 84 is pumped up by a feed pump 85 and then, pressurized by a high-pressure fuel pump 80 to be supplied to the delivery pipe 86.

A plunger 82 of the high-pressure fuel pump 80 is reciprocally moved by a cam 83 connected to the intake camshaft 32. That is, the high-pressure fuel pump 80 is one of auxiliary devices driven by drive force of the intake camshaft 32.

A spill valve 81 is provided on the high-pressure fuel pump 80. By closing the spill valve 81 in response to the reciprocal motion of the plunger 82, the fuel is pressurized and pressure fed to the delivery pipe 86. In the high-pressure fuel pump 80, an amount of the fuel to be pressure fed to the delivery pipe 86 can be changed by changing valve-closing timing of the spill valve 81.

A vacuum pump 90 for supplying a negative pressure to a brake booster 91 is connected to the intake camshaft 32 in addition to the cam 83 for driving the high-pressure fuel pump 80. When a driver performs a stepping-in operation of a brake pedal (brake operation member) 96 of a vehicle, the brake booster 91 assists the stepping-in operation by using the negative pressure. The vacuum pump 90 discharges air in the brake booster 91 by using the drive force of the intake camshaft 32. That is, the vacuum pump 90 is also an auxiliary device driven by the drive force of the intake camshaft 32. In a negative-pressure supply passage 92 connecting the brake booster 91 and the vacuum pump 90 to each other, a check valve 93 for prohibiting a flow of air from the vacuum pump 90 toward the brake booster 91 and allows only a flow of air from the brake booster 91 toward the vacuum pump 90 is provided.

A clutch 94 that can disconnect the vacuum pump 90 and the intake camshaft 32 from each other is provided between the vacuum pump 90 and the intake camshaft 32.

In the internal combustion engine 10, various sensors for detecting the operating state of the internal combustion engine 10 are provided. These various sensors include, for example, a crank position sensor 101, a cam position sensor 102, an airflow meter 103, a water temperature sensor 104, an oil temperature sensor 105 and the like. The crank position sensor 101 is provided in the vicinity of the crankshaft 16 and detects a crank angle, which is a rotational phase of the crankshaft 16 and an engine speed, which is the number of rotations of the crankshaft 16 per unit time. The cam position sensor 102 is provided in the vicinity of the intake camshaft 32 and detects a cam angle, which is a rotational phase of the intake camshaft 32. The airflow meter 103 is provided in the intake passage 14 and detects an amount of air introduced into the combustion chamber 13. The water temperature sensor 104 detects the temperature of engine cooling water. The oil temperature sensor 105 detects the temperature of hydraulic oil.

Moreover, in a vehicle on which the internal combustion engine 10 is mounted, a push-type start switch 106 operated by an operator when start of the internal combustion engine 10 is requested and a parking brake switch 107, which detects an operation of a parking brake 97, are provided. The start switch 106 outputs a start signal when being operated. The parking brake switch 107 outputs a parking brake signal when the parking brake 97 is operated. Signals outputted from these various sensors are taken into an electronic control device 100 which integrally controls various devices of the internal combustion engine 10.

The electronic control device 100 includes a calculation unit and a plurality of memories for storing and retaining various control programs and calculation maps, data calculated in execution of control and the like. The electronic control device 100 monitors a state of the internal combustion engine 10 on the basis of a detection result of each of the above described sensors and executes fuel injection control for controlling the fuel injection valve 19 and the spill valve 81 and ignition timing control for controlling the ignition plug 18 on the basis of the states. The electronic control device 100 also executes valve timing control for controlling valve timing of the intake valve 31 and the exhaust valve 41 by controlling the variable valve timing mechanisms 30 and 40 through control of the control valves 25 and 26 and executes control such as engine starting control by the starter motor 22.

Figure 2:
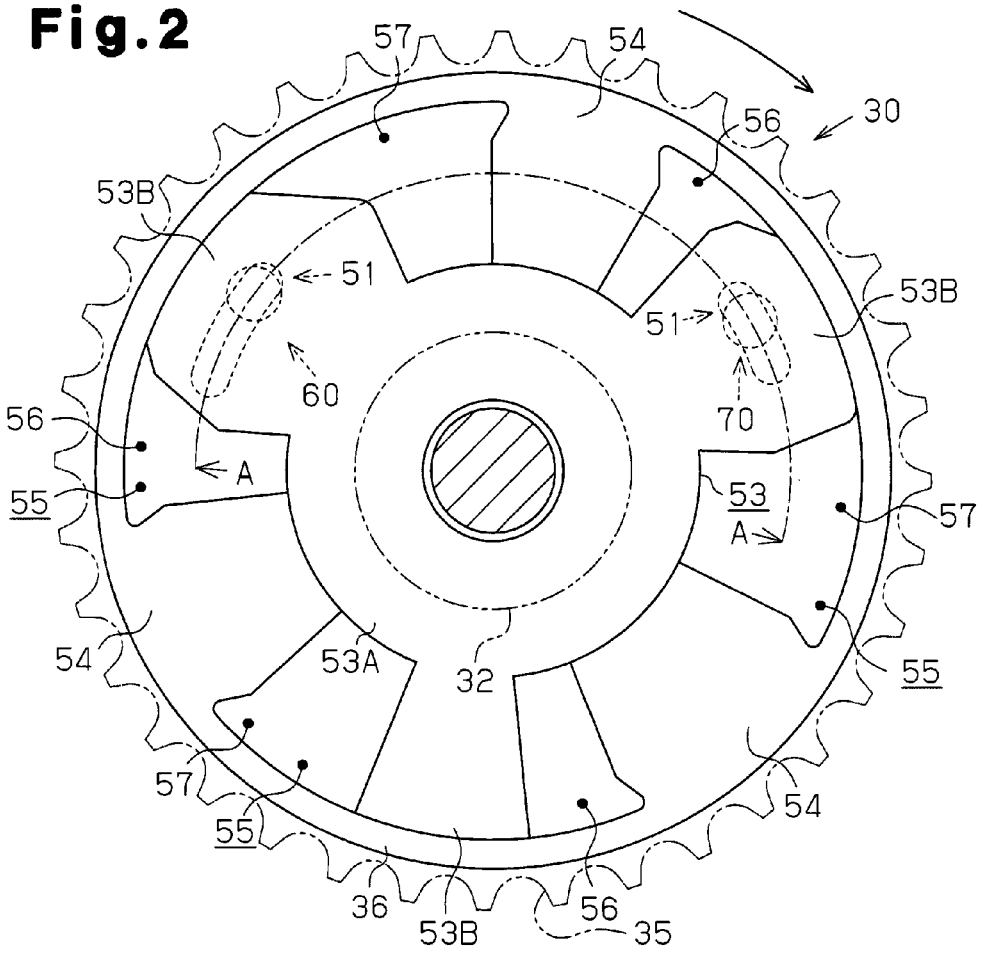
FIG. 2 is an end face diagram illustrating the internal structure of a variable valve timing mechanism of the embodiment.

Subsequently, by referring to FIG. 2, the configuration of the variable valve timing mechanism 30 will be described. The configuration of the variable valve timing mechanism 40 is basically the same as the configuration of the variable valve timing mechanism 30. Thus, detailed explanation of the configuration of the variable valve timing mechanism 40 will be omitted.

The variable valve timing mechanism 30 is configured by closing a housing 36 by a sprocket 35 in a state where a rotor 53 is accommodated in the housing 36. However, for convenience of explanation, a state where the sprocket 35 is removed from the variable valve timing mechanism 30 is illustrated in FIG. 2, and an internal structure of the variable valve timing mechanism 30 is illustrated.

In the housing 36, three partition walls 54 extending inward in the radial direction thereof are provided. Moreover, in the housing 36, the rotor 53 rotating around the same rotation axis of the housing 36 is rotationally accommodated. The rotor 53 has a boss 53A connected to the intake camshaft 32 and three vanes 53B protruding outward in the radial direction of the boss 53A. An accommodation chamber 55 is defined by each of the partition walls 54 of the housing 36 and the boss 53A of the rotor 53, and this accommodation chamber 55 is divided by each of the vanes 53B to a phase advancing hydraulic chamber 56 and a phase retarding hydraulic chamber 57, respectively.

When the crankshaft 16 rotates with the engine operation, its drive force is transmitted to the sprocket 35 of the variable valve timing mechanism 30 through the timing chain. As a result, the intake camshaft 32 rotates with the variable valve timing mechanism 30. The variable valve timing mechanism 30 and the intake camshaft 32 are assumed to rotate clockwise as indicated by an arrow in FIG. 2.

As a result, the intake valve 31 is opened/closed by the intake cam 33 provided on the intake camshaft 32.

If supply and discharge of the hydraulic oil with respect in the phase advancing hydraulic chamber 56 and the phase retarding hydraulic chamber 57 of the variable valve timing mechanism 30 are controlled through the control valve 25, the vanes 53B are displaced in the accommodation chamber 55 on the basis of a change in the hydraulic pressures in the phase advancing hydraulic chamber 56 and the phase retarding hydraulic chamber 57, and the rotor 53 rotates in the housing 36. As a result, a relative rotational phase of the rotor 53 to the sprocket 35 and the housing 36 is changed, and the relative rotational phase of the intake camshaft 32 to the crankshaft 16 is changed with that, whereby the valve timing of the intake valve 31 is changed.

Specifically, when the hydraulic oil is supplied to the phase advancing hydraulic chamber 56 while the hydraulic oil in the phase retarding hydraulic chamber 57 is discharged, the rotor 53 relatively rotates in a phase advancing direction with respect to the housing 36, whereby the valve timing is advanced. When the volume of the phase retarding hydraulic chamber 57 becomes the smallest and the vane 53B is brought into contact with the partition wall 54, the valve timing becomes the most advanced. Moreover, when the hydraulic oil is supplied to the phase retarding hydraulic chamber 57 while the hydraulic oil in the phase advancing hydraulic chamber 56 is discharged, the rotor 53 relatively rotates in a phase retarding direction with respect to the housing 36, whereby the valve timing is retarded. When the volume of the phase advancing hydraulic chamber 56 becomes the smallest and the vane 53B is brought into contact with the partition wall 54, the valve timing becomes the most retarded.

The variable valve timing mechanism 30 is provided with a lock mechanism 51 for mechanically fixing the relative rotational phase of the rotor 53 with respect to the housing 36 to a lock phase. This lock phase is a phase located between a phase to set the valve timing at the most retarded timing and a phase to set the valve timing at the most advanced timing, and the lock phase is also a relative rotational phase set at valve timing capable of starting the engine and a relative rotational phase that realizes valve timing capable of starting the engine even at low-temperature start.

The lock mechanism 51 includes a first lock mechanism 60 and a second lock mechanism 70 provided on the different vanes 53B, respectively. The lock mechanism 51 composed of the first lock mechanism 60 and the second lock mechanism 70 also has a ratchet function to advance the relative rotational phase of the rotor 53 with respect to the housing 36 from the position more retarded than the lock phase to the lock phase in a stepped manner.

Figure 3:
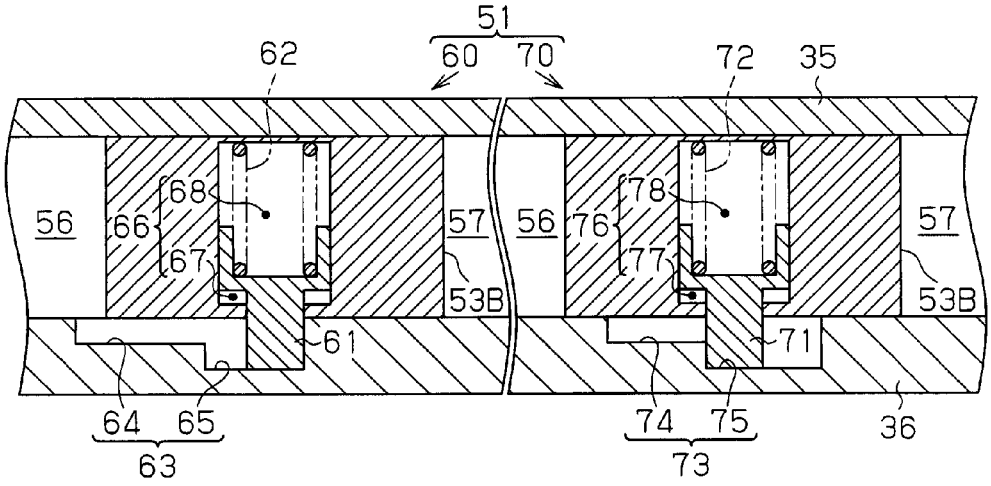
FIG. 3 is a cross-sectional view taken along line A-A in FIG. 2.
Figure 4A:
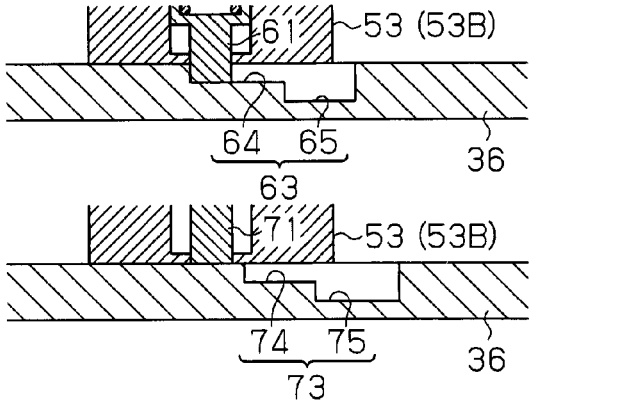
FIGS. 4(*a*), 4(*b*), 4(*c*), and 4(*d*) are cross-sectional views illustrating a state where a rotor is advanced to a lock phase by a ratchet function.
Figure 4B:
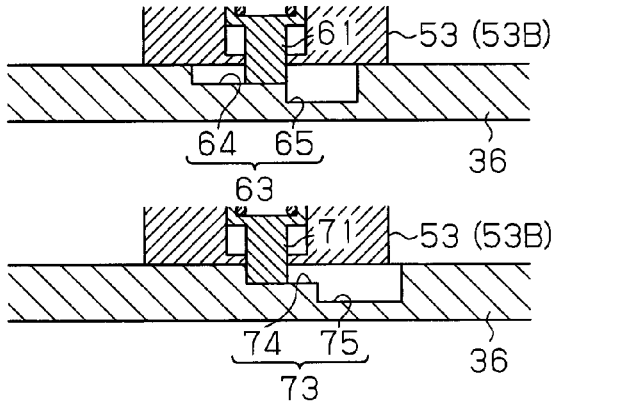
Figure 4C:
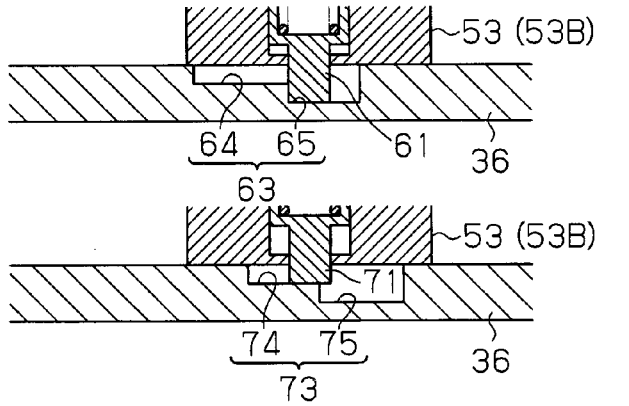
Figure 4D:
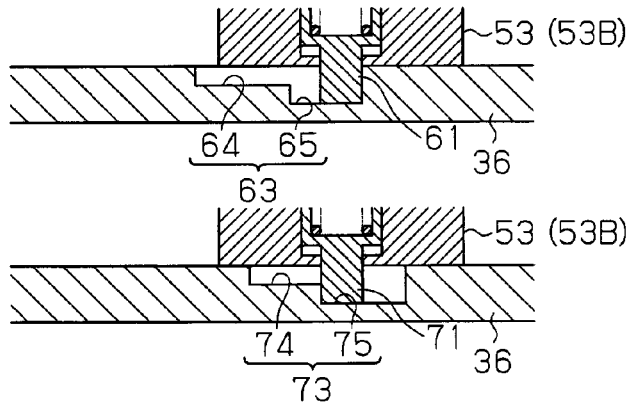

Subsequently, a detailed configuration of the lock mechanism 51 will be described by referring to FIG. 3 illustrating a cross-section taken along line A-A in FIG. 2.

The first lock mechanism 60 includes a cylindrical first lock pin 61 accommodated in the vane 53B and a first lock hole 63 into which the first lock pin 61 is fitted. This first lock hole 63 is formed in the housing 36.

The first lock pin 61 is accommodated in a vane hole 66 formed in the vane 53B and reciprocally moves therein and a part thereof protrudes to the outside of the vane 53B and fits in the first lock hole 63. The vane hole 66 is divided by the first lock pin 61 into a first spring chamber 68 located at a position closer to the sprocket 35 and a first release chamber 67 located at a position closer to the first lock hole 63. In the first spring chamber 68, a first spring 62 urging the first lock pin 61 toward the first lock hole 63 is accommodated. On the other hand, the hydraulic oil in the phase advancing hydraulic chamber 56 and the phase retarding hydraulic chamber 57 is supplied into the first release chamber 67. Therefore, if the hydraulic pressures in the phase advancing hydraulic chamber 56 and the phase retarding hydraulic chamber 57 rise, the first lock pin 61 is urged toward the sprocket 35 by force based on the hydraulic pressure.

The first lock hole 63 has an arc shape in the circumferential direction in the housing 36. In detail, the first lock hole 63 is formed of a first upper stepped portion 64 and a first lower stepped portion 65 formed deeper than the first upper stepped portion 64. The first upper stepped portion 64 is formed at a more retarded position than the first lower stepped portion 65.

The second lock mechanism 70 includes a cylindrical second lock pin 71 accommodated in the vane 53B and the second lock hole 73 into which the second lock pin 71 is fitted. This second lock hole 73 is formed in the housing 36.

The second lock pin 71 is accommodated in a vane hole 76 formed in the vane 53B and reciprocally moves therein and a part thereof protrudes to the outside of the vane 53B and fits in the second lock hole 73. The vane hole 76 is divided by the second lock pin 71 into a second spring chamber 78 closer to the sprocket 35 and a second release chamber 77 closer to the second lock hole 73. In the second spring chamber 78, a second spring 72 urging the second lock pin 71 toward the second lock hole 73 is accommodated. On the other hand, into the second release chamber 77, the hydraulic oil in the phase advancing hydraulic chamber 56 and the phase retarding hydraulic chamber 57 is supplied. Therefore, if the hydraulic pressures in the phase advancing hydraulic chamber 56 and the phase retarding hydraulic chamber 57 rise, the second lock pin 71 is urged toward the sprocket 35 by a force based on the hydraulic pressure.

The second lock hole 73 has an arc shape in the circumferential direction in the housing 36. In detail, the second lock hole 73 is formed of a second upper stepped portion 74 and a second lower stepped portion 75 formed deeper than the second upper stepped portion 74. The second upper stepped portion 74 is formed on a more retarded position than the second lower stepped portion 75.

The first upper stepped portion 64 and the first lower stepped portion 65 formed on the first lock hole 63 restrict displacement of the first lock pin 61 when the first lock pin 61 fits into the stepped portions 64 and 65. Moreover, the second upper stepped portion 74 and the second lower stepped portion 75 formed on the second lock hole 73 restrict displacement of the second lock pin 71 when the second lock pin 71 fits therein. Furthermore, when the first lock pin 61 fits into the first lower stepped portion 65 and the second lock pin 71 fits into the second lower stepped portion 75, the displacement of the first lock pin 61 in the phase advancing direction is restricted by an inner wall on the phase advancing side of the first lower stepped portion 65. At the same time, the displacement of the second lock pin 71 is restricted by an inner wall on the phase retarding side of the second lower stepped portion 75. As a result, the relative rotational phase of the rotor 53 with respect to the housing 36 is fixed to the lock phase. In FIG. 3, a state where the lock mechanism 51 fixes the relative rotational phase of the rotor 53 to the lock phase.

When engine stop is requested, the hydraulic pressure of the phase advancing hydraulic chamber 56 and the phase retarding hydraulic chamber 57 is controlled through the control valve 25 so that the rotor 53 rotates to the lock phase. When the hydraulic oil is discharged from the first release chamber 67 of the first lock mechanism 60 and the hydraulic pressure in the first release chamber 67 lowers, the first lock pin 61 urged by the first spring 62 fits into the first lower stepped portion 65 of the first lock hole 63. At the same time, when the hydraulic oil is discharged from the second release chamber 77 of the second lock mechanism 70 and the hydraulic pressure in the second release chamber 77 lowers, the second lock pin 71 urged by the second spring 72 fits into the second lower stepped portion 75 of the second lock hole 73. As a result, the displacement of the first lock pin 61 in the phase advancing direction is restricted by the inner wall on the phase advancing side of the first lower stepped portion 65, and the displacement of the second lock pin 71 in the phase retarding direction is restricted by the inner wall on the phase retarding side of the second lower stepped portion 75, and the rotational motion of the rotor 53 is restricted by the lock mechanism 51. That is, the valve timing is fixed to valve timing suitable for engine starting.

If a start request of the internal combustion engine 10 is made while the rotational motion of the rotor 53 is restricted by the lock mechanism 51, cranking is started in a state where the valve timing is fixed to the valve timing suitable for the engine starting. Thus, the internal combustion engine 10 is started readily.

When the engine starting is completed and the hydraulic pressure supplied from the oil pump 20 becomes sufficiently high, the first lock pin 61 is withdrawn from the first lock hole 63, and the second lock pin 71 is withdrawn from the second lock hole 73. Specifically, if the hydraulic oil is supplied to the first release chamber 67 of the first lock mechanism 60 and the hydraulic pressure of this first release chamber 67 rises higher than the release hydraulic pressure, the first lock pin 61 is moved toward the sprocket 35 by the urging force based on this hydraulic pressure and is withdrawn from the first lock hole 63. Moreover, if the hydraulic oil is also supplied to the second release chamber 77 of the second lock mechanism 70 and the hydraulic pressure of this second release chamber 77 rises higher than the release hydraulic pressure, the second lock pin 71 is moved toward the sprocket 35 by the urging force based on this hydraulic pressure and is withdrawn from the second lock hole 73. As a result, the relative rotation between the housing 36 and the rotor 53 is allowed, and the control of the control valve 25 is executed so that the valve timing is changed to the timing suitable for the engine operation state.

On the other hand, if the relative rotational phase of the rotor 53 cannot be fixed to the lock phase when the engine stop request is made, the rotational motion of the rotor 53 cannot be restricted by the lock mechanism 51. Thus, the operation of the internal combustion engine 10 is stopped while the valve timing cannot be fixed to the valve timing suitable for the engine starting.

If a start request of the internal combustion engine 10 is made after the operation of the internal combustion engine 10 is stopped while the valve timing cannot be fixed to the valve timing suitable for the engine starting as above, there is a concern that engine starting performance will deteriorate such that the engine starting becomes impossible or such that it requires a long time to start the engine.

Thus, the lock mechanism 51 of this embodiment is provided with the above described ratchet function in order to improve the engine starting performance if the operation of the internal combustion engine 10 is stopped while the valve timing cannot be fixed to the valve timing suitable for the engine starting. By means of this ratchet function, the rotor 53 is advanced to the lock phase by using a torque acting on the intake camshaft 32 in cranking.

Subsequently, by referring to FIG. 4, a process of advancing the rotor 53 to the lock phase by using the ratchet function will be described. FIGS. 4(*a*) to 4(*d*) sequentially show the process of advancing the rotor 53 to the lock phase by using the ratchet function. In FIGS. 4(*a*) to 4(*d*), the first lock mechanism 60 and the second lock mechanism 70 are vertically arranged so that the relationship between the operation state of the first lock mechanism 60 and the operation state of the second lock mechanism 70 can be easily understood.

During the engine operation, with opening/closing of the intake valve 31 by the intake cam 33, a positive torque for rotating the rotor 53 and the intake camshaft 32 in a direction for retarding the valve timing by the urging force of the valve spring 34 and a negative torque for rotating the rotor 53 and the intake camshaft 32 in a direction of advancing of the valve timing act alternately. If such torque acts on the rotor 53 and the intake camshaft 32 under circumstances that the hydraulic pressure in the phase advancing hydraulic chamber 56 and the phase retarding hydraulic chamber 57 has not sufficiently risen at the engine starting when the rotor 53 is not fixed by the lock mechanism 51, the rotor 53 turns alternately in the phase advancing direction and the phase retarding direction in the housing 36. That is, if the negative torque acts, the rotor 53 rotates in the phase advancing direction with respect to the housing 36, while, if the positive torque acts, the rotor 53 rotates in the phase retarding direction with respect to the housing 36.

If the negative torque acts on the intake camshaft 32 as described above when the valve timing is the most retarded timing, for example, the rotation speed of the rotor 53 connected to the intake camshaft 32 temporarily exceeds the rotation speed of the housing 36 connected to the crankshaft 16. As a result, the rotor 53 relatively rotates in the phase advancing direction with respect to the housing 36, and the first lock pin 61 and the second lock pin 71 are displaced in the phase advancing direction. When the first lock pin 61 is displaced to a position capable of fitting into the first upper stepped portion 64, the first lock pin 61 fits into the first upper stepped portion 64, as illustrated in FIG. 4(*a*). In this state, the positive torque acts on the intake camshaft 32, and when the housing 36 and the rotor 53 are to relatively rotate in the direction of retarding the valve timing, the first lock pin 61 is brought into contact with the inner wall on the phase retarding side of the first upper stepped portion 64. Thus, relative rotation of the housing 36 and the rotor 53 in the direction of retarding the valve timing is restricted.

Then, if the negative torque acts on the intake camshaft 32 in this state, the rotor 53 further relatively rotates in the phase advancing direction with respect to the housing 36, and the first lock pin 61 and the second lock pin 71 are displaced in the phase advancing direction. When the second lock pin 71 is displaced to a position capable of fitting into the second upper stepped portion 74, the second lock pin 71 fits into the second upper stepped portion 74, as illustrated in FIG. 4(*b*). If the positive torque acts on the intake camshaft 32 in this state, and if the housing 36 and the rotor 53 are to relatively rotate in the direction of retarding the valve timing, the second lock pin 71 is brought into contact with the inner wall on the phase retarding side of the second upper stepped portion 74. Thus, the relative rotation of the housing 36 and the rotor 53 in the direction of retarding the valve timing is restricted.

Subsequently, if the negative torque acts on the intake camshaft 32, the rotor 53 further relatively rotates in the phase advancing direction with respect to the housing 36, and the first lock pin 61 and the second lock pin 71 are displaced in the phase advancing direction. When the first lock pin 61 is displaced to a position capable of fitting into the first lower stepped portion 65, the first lock pin 61 fits into the first lower stepped portion 65, as illustrated in FIG. 4(*c*). If the positive torque acts on the intake camshaft 32 in this state, and the housing 36 and the rotor 53 are to relatively rotate in the direction of retarding the valve timing, the first lock pin 61 is brought into contact with the inner wall on the phase retarding side of the first lower stepped portion 65. Thus, the relative rotation of the housing 36 and the rotor 53 in the direction of retarding the valve timing is restricted.

Then, if the negative torque acts on the intake camshaft 32 in this state, the rotor 53 further relatively rotates in the phase advancing direction with respect to the housing 36, and the first lock pin 61 and the second lock pin 71 are displaced in the phase advancing direction. When the second lock pin 71 is displaced to a position capable of fitting into the second lower stepped portion 75, the second lock pin 71 fits into the second lower stepped portion 75, and the rotor 53 is fixed to the lock phase, as illustrated in FIG. 4(*d*). If the positive torque acts on the intake camshaft 32 in this state, and the housing 36 and the rotor 53 are to relatively rotate in the direction of retarding the valve timing, the second lock pin 71 is brought into contact with the inner wall on the phase retarding side of the second lower stepped portion 75. Thus, the relative rotation of the housing 36 and the rotor 53 in the direction of retarding the valve timing is restricted.

As described above, if the rotor 53 turns in the housing 36, the lock pins 61 and 71 sequentially fit into the stepped portions 64, 74, 65, and 75 with different depths provided on the lock holes 63 and 73 of the lock mechanism 51. As a result, the rotor 53 rotates gradually to the lock phase and finally, the rotor 53 reaches the lock phase, and the rotor 53 is fixed by the lock mechanism 51.

However, if the temperature of the hydraulic oil is low and the viscosity of the hydraulic oil is high, a rotation amount of the rotor 53 generated when the positive torque and the negative torque act becomes small. As a result, the lock pins 61 and 71 cannot be sequentially fitted into the stepped portions 64, 74, 65, and 75 located in the phase advancing direction, and it becomes difficult to fix the rotor 53 by the lock mechanism 51 by rotating the rotor 53 to the lock phase during execution of the cranking.

Figure 5:
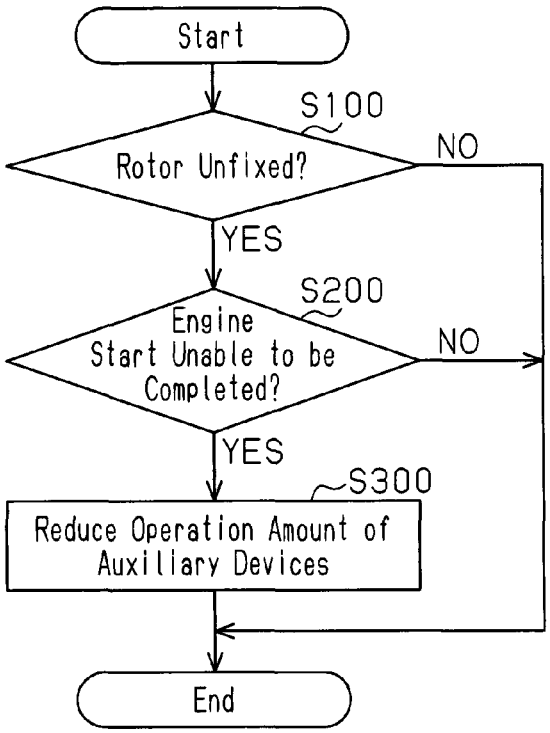
FIG. 5 is a flowchart illustrating the flow of a process executed at an engine starting in the embodiment.

Thus, in this embodiment, a series of process illustrated in FIG. 5 is executed at the engine starting, and the operation amount of the auxiliary devices driven by the drive force of the intake camshaft 32 is reduced as necessary.

The series of processes illustrated in FIG. 5 is executed by the electronic control device 100 at the engine starting.

When this process is started, the electronic control device 100 first determines at Step S100 whether the rotor 53 is not fixed by the lock mechanism 51. Whether the rotor 53 is fixed by the lock mechanism 51 or not can be determined on the basis of a crank angle detected by the crank position sensor 101 and the cam angle detected by a cam position sensor 102. That is, if the relative rotational phase of the intake camshaft 32 with respect to the crankshaft 16 estimated on the basis of the crank angle and the cam angle is a relative rotational phase corresponding to the lock phase, it is determined that the relative rotational phase of the rotor 53 is fixed to the lock phase and that the rotor 53 is fixed by the lock mechanism 51. On the other hand, if the relative rotational phase of the intake camshaft 32 with respect to the crankshaft 16 estimated on the basis of the crank angle and the cam angle is not a relative rotational phase corresponding to the lock phase, it is determined that the rotor 53 is not fixed by the lock mechanism 51.

If the electronic control device 100 determines at Step S100 that the rotor 53 is unfixed, or not fixed by the lock mechanism 51 (Step S100; YES), the routine proceeds to Step S200, and the electronic control device 100 determines whether the engine starting cannot be completed. Whether the engine starting cannot be completed is determined on the basis of an engine speed detected by the crank position sensor 101, that is, on the basis of whether a state where the rotation speed of the crankshaft 16 has not risen to a level (400 rpm, for example), at which the engine starting is determined to be completed, has continued for a predetermined period or not. In other words, if the rotation speed of the crankshaft 16 has not risen to the level at which the engine starting is determined to be completed even after a predetermined period has elapsed since start of the engine starting and a state where the engine speed has not risen to the level at which the engine starting is determined to be completed has continued for the predetermined period, it is determined that the engine starting cannot be completed. The length of the predetermined period may be set on the basis of a length of the period in which the engine starting should have been completed in an ordinary case.

If the electronic control device 100 determines at Step S200 that the engine starting is unable to be completed (Step S200: YES), the routine proceeds to Step 300, and the electronic control device 100 reduces the operation amount of the auxiliary devices. Specifically, by holding the spill valve 81 of the high-pressure fuel pump 80 in an open state, the operation amount of the high-pressure fuel pump 80 is reduced. Moreover, at this Step S300, an operation amount of the vacuum pump 90 is also reduced on condition that a parking brake signal is outputted from the parking brake switch 107. That is, the operation amount of the vacuum pump 90 is also reduced on condition that the parking brake 97 is operating.

When the operation amount of the vacuum pump 90 is to be reduced, the vacuum pump 90 and the intake camshaft 32 are disconnected from each other by the clutch 94 to stop the operation of the vacuum pump 90.

The electronic control device 100 continues the engine starting in a state where the operation amounts of the high-pressure fuel pump 80 and the vacuum pump 90 are reduced and finishes this process when the rotor 53 is fixed to the lock phase by the lock mechanism 51 and the engine starting is completed.

On the other hand, if the electronic control device 100 determines at Step S100 that the rotor 53 is not unfixed, or is fixed by the lock mechanism 51 (Step S100: NO), the electronic control device 100 continues the engine starting as it is without reducing the operation amount of the auxiliary devices and finishes this process when the engine starting is completed. Moreover, if the electronic control device 100 determines at Step S200 that the engine starting not unable to be completed (Step S200: NO), too, the electronic control device 100 continues the engine starting as it is without reducing the operation amount of the auxiliary devices and finishes this process when the engine starting is completed.

Operation of the embodiment described above will be described.

According to the above described embodiment, when the rotor 53 is unfixed, or not fixed by the lock mechanism 51 (Step S100: YES) and the engine starting is unable to be completed (Step S200: YES), the operation amounts of the high-pressure fuel pump 80 and the vacuum pump 90, which are auxiliary devices driven by the drive force of the intake camshaft 32, are reduced.

The higher the operation amount of the auxiliary devices driven by the drive force of the intake camshaft 32, the larger the load acting when the intake camshaft 32 is rotated becomes. Thus, the higher the operation amount of the auxiliary devices driven by the drive force of the intake camshaft 32, the more difficult it becomes for the intake camshaft 32 and the rotor 53 to rotate in the phase advancing direction. On the other hand, according to the above described embodiment, since the operation amounts of the high-pressure fuel pump 80 and the vacuum pump 90, which are auxiliary devices driven by the drive force of the intake camshaft 32, are reduced when the rotor 53 is rotated to the lock phase in the phase advancing direction, the rotor 53 can rotate in the phase advancing direction easily.

According to the embodiment described above, the following advantages are obtained.

(1) The operation amount of the high-pressure fuel pump 80 and the operation amount of the vacuum pump 90 are reduced, making it easier for the rotor 53 to rotate in the phase advancing direction. Thus, even if the rotor 53 is not fixed by the lock mechanism 51 at the engine starting, the rotor 53 can be rotated quickly to the lock phase to fix the rotor 53 to the lock phase by the lock mechanism 51, and the engine starting is completed at an early stage.

(2) When the rotor 53 rotates in the housing 36 when the intake valve 31 is opened/closed with the rotation of the intake camshaft 32 at the engine starting by the action of the ratchet function, the rotor 53 rotates toward the lock phase in the phase advancing direction. At this time, the operation amount of the high-pressure fuel pump 80 and the operation amount of vacuum pump 90 are reduced, and thus, the rotor 53 rotates in the phase advancing direction easily when the rotor 53 rotates in the housing 36. Therefore, even if the oil temperature is low and the viscosity of the hydraulic oil is high, a decrease of the rotation amount of the rotor 53 in the phase advancing direction can be suppressed. Thus, even if the oil temperature is low and the viscosity of the hydraulic oil is high, the rotor 53 can be rotated to the lock phase quickly to fix the rotor 53 to the lock phase by the lock mechanism 51, and the engine starting is completed at an early stage.

(3) If the operation amount of the vacuum pump 90 supplying the negative pressure to the brake booster 91 is reduced, the function of the brake booster 91 for reducing power required for an operation of a brake pedal 96 is decreased.

On the other hand, if the parking brake 97 is operating, even if the car is stopped and the function of the brake booster 91 is decreased, it can be estimated that the stop state can be maintained.

In the above described embodiment, the operation amount of the vacuum pump 90 is reduced on condition that the parking brake 97 is operating. Thus, even on a slope or the like, the operation amount of the vacuum pump 90 can be reduced and the engine starting is completed at an early stage while the stop state is maintained.

(4) If the operation amount of the high-pressure fuel pump 80 is reduced, there is a concern that a fuel pressure for performing appropriate fuel injection cannot be ensured.

On the other hand, if a state where a rotation speed of the crankshaft 16 does not rise to a level at which completion of the engine starting is determined continues, it is estimated that the engine starting cannot be completed even if fuel is injected.

In the above described embodiment, the operation amount of the high-pressure fuel pump 80 is reduced on condition that the state where the rotation speed of the crankshaft 16 does not rise with the engine starting to the level at which completion of the engine starting is determined continues. Thus, such a situation can be suppressed that the operation amount of the high-pressure fuel pump 80 is reduced in the state where the engine starting can be completed without reducing the operation amount of the high-pressure fuel pump 80 and as a result, taking longer to start the engine.

(5) Whether the engine starting cannot be completed is determined on the basis of the rotation speed of the crankshaft 16. That is, whether the engine starting is completed or not is determined on the basis of whether the rotation speed of the crankshaft 16 rises to the level at which completion of the engine starting can be actually determined. Therefore, whether the engine starting cannot be completed can be determined more accurately not only on the basis of the influences of the oil temperature and the hydraulic pressure but also on the state of combustion in the combustion chamber 13 or the state of fluctuation of the engine speed.

The control device for an internal combustion engine according to the present invention is not limited to those exemplified in the above described embodiment and may be modified in the following forms, for example, by changing the above described embodiment as appropriate.

In the above described embodiment, the engine starting is started after a start signal is outputted when the push-type start switch 106 is operated. However, a form in which the engine starting is performed on condition that an ignition key is held at a start position may be employed.

In the above described embodiment, whether the rotor 53 is fixed by the lock mechanism 51 or not is determined on the basis of whether the relative rotational phase of the intake camshaft 32 with respect to the crankshaft 16 is a relative rotational phase corresponding to the lock phase at the engine starting or not. However, it may be so configured that whether the rotor 53 has proceeded to a state fixed by the lock mechanism 51 or not is determined when the engine is stopped, the determination result is stored in a memory of the electronic control device 100, and it is determined whether the rotor 53 is fixed by the lock mechanism 51 or not by referring to the data stored in the memory at the subsequent engine starting.

Moreover, a sensor capable of detecting whether the rotor 53 is fixed by the lock mechanism 51 or not may be provided so that it can be determined whether the rotor 53 is fixed by the lock mechanism 51 or not on the basis of the detection result of this sensor.

The configuration of the lock mechanism 51 illustrated in the above described embodiment is an example and may be changed as appropriate. For example, in each of the above described embodiments, the lock mechanism 51 is composed of the first lock mechanism 60 and the second lock mechanism 70. In contrast, the lock mechanism 51 may be composed of a single lock mechanism. In this case, too, the ratchet function can be provided by forming a plurality of stepped portions having different depths on the lock hole.

In the above described embodiment, the first lock pin 61 and the second lock pin 71 are both provided on the rotor 53, while the first lock hole 63 and the second lock hole 73 are both provided in the housing 36. In contrast, a configuration in which the lock pins 61 and 71 are both provided on the housing 36, while the lock holes 63 and 73 are both provided in the rotor 53 may be employed. Moreover, it may be so configured that the first lock pin 61 is provided on the rotor 53 and the first lock hole 63 is provided in the housing 36, while the second lock pin 71 is provided on the housing 36 and the second lock hole 73 is provided in the rotor 53. Further to the contrary, it may be so configured that the first lock pin 61 is provided on the housing 36 and the first lock hole 63 is provided in the rotor 53, while the second lock pin 71 is provided on the rotor 53 and the second lock hole 73 is provided in the housing 36.

Moreover, as a configuration of the lock mechanism, a configuration may be employed in which a lock pin is provided in a form protruding from the outer peripheral surface of the rotor 53, while a lock hole into which this lock pin fits is provided in the inner peripheral surface of the housing 36.

In the above described embodiment, the example embodying a control device for an internal combustion engine provided with both the variable valve timing mechanism 30 for changing the valve timing of the intake valve 31 and the variable valve timing mechanism 40 for changing the valve timing of the exhaust valve 41 is illustrated. In contrast, the present invention may be embodied as a control device for an internal combustion engine provided only with the variable valve timing mechanism 30 for changing the valve timing of the intake valve 31. Moreover, the present invention may also be embodied as a control device for an internal combustion engine provided only with the variable valve timing mechanism 40 for changing the valve timing of the exhaust valve 41.

In a hybrid vehicle provided with a motor generator in addition to the internal combustion engine 10 as a vehicle drive source, the engine starting is performed through this motor generator. The series of control described in the above embodiment can be also applied to the case in which the engine starting is performed by the motor generator.

In the above described embodiment, the ratchet function is provided in the lock mechanism 51 and the rotor 53 is rotated to the lock phase in the phase advancing direction by using the swing of the rotor 53 at the engine starting. However, the configuration of rotating the rotor 53 to the lock phase in the phase advancing direction can be changed as appropriate. For example, instead of the configuration in which the ratchet function is provided in the lock mechanism 51, a configuration may be employed in which the rotor 53 is rotated to the lock phase in the phase advancing direction by controlling the hydraulic pressure in each hydraulic chamber of the variable valve timing mechanism.

According to the above configuration, the rotor 53 is rotated to the lock phase in the phase advancing direction by the hydraulic pressure. At this time, since the operation amount of the auxiliary devices is reduced, the rotor 53 is rotated in the phase advancing direction even with a low hydraulic pressure. Therefore, even at the engine starting when it is difficult to ensure a stable hydraulic pressure, the rotor 53 can be rotated quickly to the lock phase to fix the rotor 53 to the lock phase by the lock mechanism 51, and the engine starting is completed at an early stage.

In the internal combustion engine 10, which is provided with the lock mechanism 51 having the ratchet function as in the above described embodiment, a configuration may be employed in which the rotor 53 is rotated to the lock phase in the phase advancing direction by the hydraulic pressure at the engine starting so that the rotor 53 can be rotated to the lock phase by using both the action by the ratchet function and the action of the hydraulic pressure.

Figure 6:
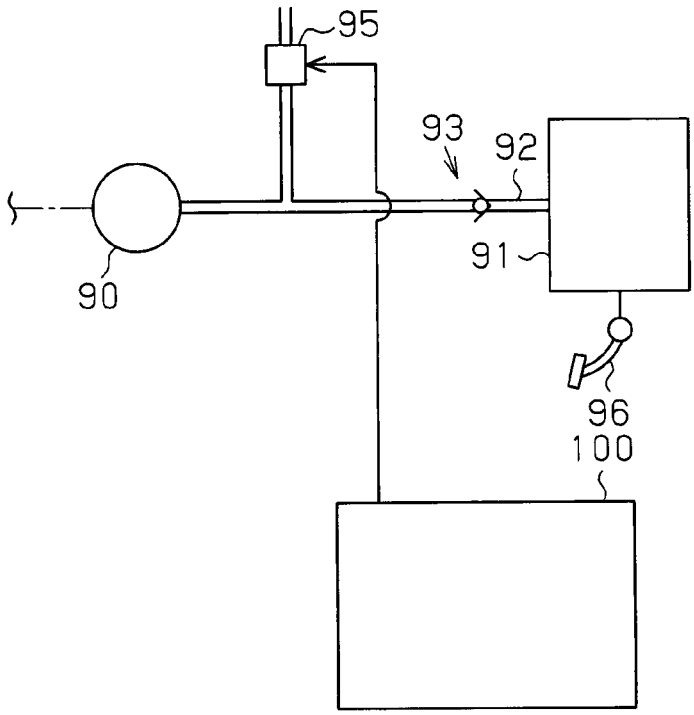
FIG. 6 is a schematic diagram illustrating a configuration for reducing an operation amount of a vacuum pump according to another embodiment of the present invention.

In the above described embodiment, the vacuum pump 90 and the intake camshaft 32 are disconnected from each other by the clutch 94 and the operation of the vacuum pump 90 is stopped, by which the operation amount of the vacuum pump 90 is reduced. However, the configuration for reducing the operation amount of the vacuum pump 90 may be changed as appropriate. For example, instead of the configuration of providing the clutch 94, a configuration may be employed in which a relief valve 95 is provided in the negative-pressure supply passage 92 as illustrated in FIG. 6. If such a configuration is employed, the electronic control device 100 can reduce the operation amount of the vacuum pump 90 by opening the relief valve 95 to open a portion closer to the vacuum pump 90 side than the check valve 93 in the negative-pressure supply passage 92 to the atmosphere.

Figure 7:
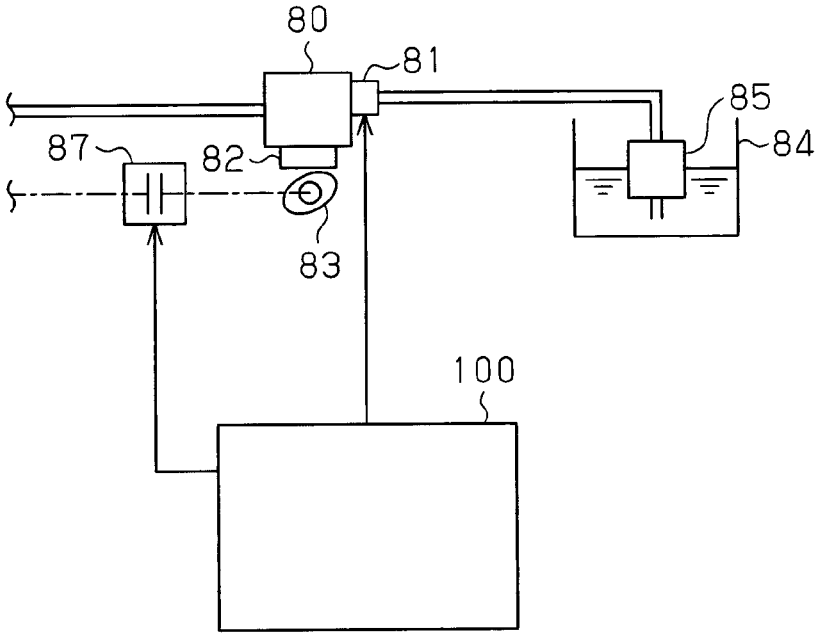
FIG. 7 is a schematic diagram illustrating a configuration for reducing the operation amount of a high-pressure fuel pump according to another embodiment of the present invention.

In the above described embodiment, the operation amount of the high-pressure fuel pump 80 is reduced by maintaining the spill valve 81 of the high-pressure fuel pump 80 in the open state. However, the configuration in which the operation amount of the high-pressure fuel pump 80 is reduced may be changed as appropriate. For example, a configuration may be employed in which a clutch 87 capable of disconnecting the cam 83 of the high-pressure fuel pump 80 and the intake camshaft 32 from each other is provided as illustrated in FIG. 7. If such a configuration is employed, the electronic control device 100 can reduce the operation amount of the high-pressure fuel pump 80 by disconnecting the cam 83 of the high-pressure fuel pump 80 and the intake camshaft 32 from each other by the clutch 87 and by stopping the operation of the high-pressure fuel pump 80.

In the above described embodiment, the high-pressure fuel pump 80 and the vacuum pump 90 are illustrated as auxiliary devices driven by the drive force of the camshaft, and the configuration for reducing their operation amount is illustrated. However, the types of the auxiliary devices whose operation amounts are to be reduced may be changed as appropriate by reducing the operation amount of the auxiliary devices driven by the camshaft, since a load acting on the camshaft is reduced, and the rotation movement of the rotor connected to this camshaft in the phase advancing direction is promoted.

Figure 8:
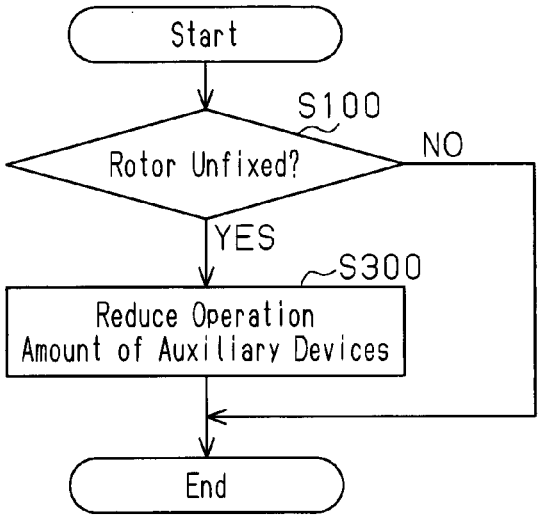
FIG. 8 is a flowchart illustrating the flow of a process executed at the engine starting according to another embodiment of the present invention.

In the above described embodiment, when the rotor 53 is unfixed, or not fixed by the lock mechanism 51 (Step S100: YES) and when the engine starting is unable to be completed (Step S200: YES), the operation amount of the high-pressure fuel pump 80 and the vacuum pump 90 is reduced, but the process at Step S200 may be omitted as illustrated in FIG. 8. That is, it may be configured such that, if the rotor 53 is unfixed, or not fixed by the lock mechanism 51 (Step S100: YES), the operation amount of the auxiliary devices is reduced regardless of whether the engine starting cannot be completed.

In this case, too, the rotor 53 can be rotated in the phase advancing direction easily by reducing the operation amount of the auxiliary devices, and the rotor 53 can be rotated to the lock phase quickly to fix the rotor 53 to the lock phase by the lock mechanism 51.

However, if such a configuration is employed, although the rotor 53 is not fixed by the lock mechanism 51, the operation amount of the high-pressure fuel pump 80 is also reduced when the engine starting can be completed without reducing the operation amount of the high-pressure fuel pump 80. Thus, although the rotor 53 can be fixed by the lock mechanism 51 more quickly, there is a concern that engine starting might take more time. Therefore, in order to reduce time required for the engine starting as much as possible, it is preferable that the operation amount of the high-pressure fuel pump 80 and the vacuum pump 90 be reduced if the rotor 53 is unfixed, or not fixed by the lock mechanism 51 (Step S100: YES) and also if the engine starting is unable to be completed (Step S200: YES) as in the above described embodiment.

Figure 9:
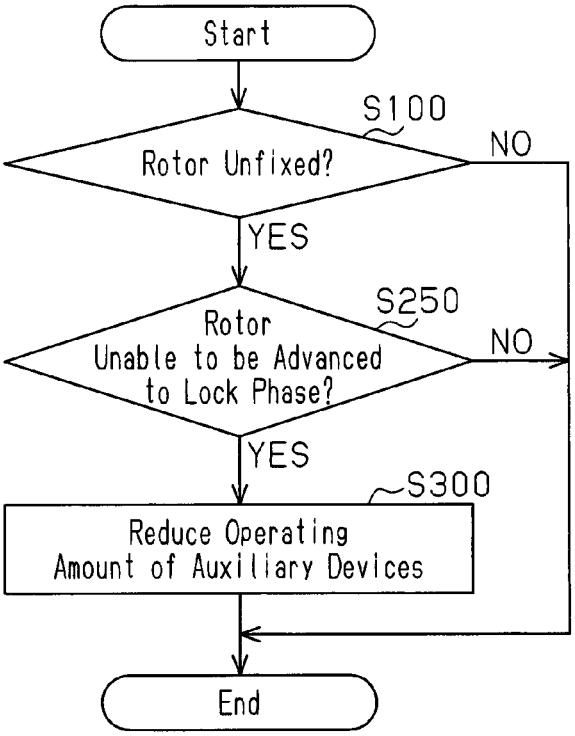
FIG. 9 is a flowchart illustrating the flow of a process executed at the engine starting according to another embodiment of the present invention.

Instead of the process at Step S200 of determining whether the engine starting cannot be completed, a configuration may be employed in which it is determined at Step S250 whether the rotor 53 is unable to be advanced to the lock phase as illustrated in FIG. 9 may be also employed.

In this case, if the electronic control device 100 determines at Step S100 that the rotor 53 is unfixed, or not fixed by the lock mechanism 51 (Step S100: YES), the routine proceeds to Step S250 in which the electronic control device 100 determines whether the rotor 53 is unable to be advanced to the lock phase. Whether the rotor 53 is unable to be advanced to the lock phase can be determined on the basis of the oil temperature. In short, if the oil temperature is low, it can be estimated that the viscosity of the hydraulic oil is high and the rotation amount of the rotor 53 generated when the positive torque and the negative torque act becomes small. Thus, it can be determined that the rotor 53 is unable to be advanced to the lock phase by the action of the ratchet function.

Moreover, if the rotor 53 is to be advanced to the lock phase by the hydraulic pressure, it can be also estimated whether the rotor 53 is unable to be advanced to the lock phase on the basis of the engine speed, which is the rotation speed of the crankshaft 16. If the engine speed is low, it is estimated that the driving amount of the oil pump 20 driven by the drive force of the crankshaft 16 is also low and the hydraulic pressures supplied to the variable valve timing mechanisms 30 and 40 are also low. Therefore, it can be determined that the rotor 53 is unable to be advanced by the hydraulic pressure to the lock phase.

If the electronic control device 100 determines at Step S250 that the rotor 53 is unable to be advanced to the lock phase as above (Step S250: YES), the routine proceeds to Step 300, and the electronic control device 100 reduces the operation amount of the auxiliary devices.

On the other hand, if the electronic control device 100 determines at Step S250 that the rotor 53 is not unable to advanced to the lock phase (Step S250: NO), the electronic control device 100 continues the engine starting without reducing the operation amount of the auxiliary devices and finishes this process when the engine starting is completed.

When such a configuration is employed, too, even if the rotor 53 is not fixed by the lock mechanism 51 at the engine starting, the rotor 53 can be rotated to the lock phase quickly to fix the rotor 53 to the lock phase by the lock mechanism 51, and the engine starting is completed at an early stage similarly to the above described embodiment.

Instead of the configuration in which the electronic control device 100 determines whether the rotor 53 can be advanced to the lock phase based on the oil temperature, a configuration may be employed in which a hydraulic sensor 108 is provided as indicated by a broken line in the lower right of FIG. 1, and this determination is made on the basis of the magnitude of the hydraulic pressure detected by the hydraulic sensor 108. In this case, the electronic control device 100 determines that the rotor 53 is unable to be advanced to the lock phase if the hydraulic pressure detected by the hydraulic sensor 108 is less than a hydraulic pressure required for rotating the rotor 53 to the lock phase.

DESCRIPTION OF THE REFERENCE NUMERALS

10 internal combustion engine
11 cylinder
12 piston
13 combustion chamber
14 intake passage
15 exhaust passage
16 crankshaft
17 connecting rod
18 ignition plug
19 fuel injection valve
20 oil pump
21 oil pan
22 starter motor
24 hydraulic oil passage
25, 26 control valve
30 variable valve timing mechanism
31 intake valve
32 intake camshaft
33 intake cam
34 valve spring
35 sprocket
36 housing
40 valve timing variable mechanism
41 exhaust valve
42 exhaust camshaft
43 exhaust cam
44 valve spring
51 lock mechanism
53 rotor
53A boss
53B vane
54 partition wall
55 accommodation chamber
56 phase advancing hydraulic chamber
57 phase retarding hydraulic chamber
60 first lock mechanism
61 first lock pin
62 first spring
63 first lock hole
64 first upper stepped portion
65 first lower stepped portion
66 vane hole
67 first release chamber
68 first spring chamber
70 second lock mechanism
71 second lock pin
72 second spring
73 second lock hole
74 second upper stepped portion
75 second lower stepped portion
76 vane hole
77 second release chamber
78 second spring chamber
80 high-pressure fuel pump
81 spill valve
82 plunger
83 cam
84 fuel tank
85 feed pump
86 delivery pipe
87 clutch
90 vacuum pump
91 brake booster
92 negative-pressure supply passage
93 check valve
94 clutch
95 relief valve
96 brake pedal
97 parking brake
100 electronic control device
101 crank position sensor
102 cam position sensor
103 airflow meter
104 water temperature sensor
105 oil temperature sensor
106 start switch
107 parking brake switch
108 hydraulic sensor

The invention claimed is:

1. A control device for an internal combustion engine, comprising:

a hydraulically-driven variable valve timing mechanism, which has a housing rotating in conjunction with rotation of a crankshaft and a rotor connected to a camshaft and which changes valve timing by changing a relative rotational phase of the rotor with respect to the housing by using a hydraulic pressure;

a lock mechanism for fixing the relative rotational phase of the rotor with respect to the housing to a locked phase by inserting a lock pin into a lock hole; and an auxiliary device driven by drive force of the camshaft, wherein if the rotor is not fixed by the lock mechanism at the engine starting, the rotor is rotated to the locked phase in the phase advancing direction and the rotor is fixed by the lock mechanism, and an operation amount of the auxiliary device is reduced when the rotor is rotated to the locked phase in the phase advancing direction at the engine starting.

2. The control device for an internal combustion engine according to claim 1, wherein a plurality of stepped portions having different depths are arranged on a bottom face of the lock hole such that the depths become deeper toward the locked phase, and the lock mechanism is provided with a ratchet function such that when the rotor rotates in the housing, the rotor is rotated toward the locked phase in the phase advancing direction by sequentially fitting the lock pin in the stepped portions.

3. The control device for an internal combustion engine according to claim 1, wherein the control device rotates the rotor to the lock phase in the phase advancing direction by using a hydraulic pressure.

4. The control device for an internal combustion engine according to claim 1, wherein the internal combustion engine is mounted on a vehicle provided with a brake operating member operated by a driver, a brake booster assisting the operation of the brake operating member by using a negative pressure, and a parking brake, the auxiliary device includes a vacuum pump for supplying a negative pressure to the brake booster, and the control device reduces the operation amount of the vacuum pump on condition that the parking brake is operating.

5. The control device for an internal combustion engine according to claim 4, wherein the control device is provided with a clutch capable of disconnecting the vacuum pump and the camshaft from each other, and the control device stops operation of the vacuum pump by disconnecting the vacuum pump and the camshaft from each other by the clutch, thereby reducing the operation amount of the vacuum pump.

6. The control device for an internal combustion engine according to claim 4, wherein the control device is provided with a negative-pressure supply passage, to which the vacuum pump is connected, and a relief valve for opening the negative-pressure supply passage to the atmosphere, and the control device opens the negative-pressure supply passage by opening the relief valve, thereby reducing the operation amount of the vacuum pump.

7. The control device for an internal combustion engine according to claim 1, wherein the auxiliary device includes a high-pressure fuel pump, and the control device reduces an operation amount of the high-pressure fuel pump on condition that a state where a rotation speed of the crankshaft does not rise with the engine starting to a level at which completion of the engine starting is determined has continued.

8. The control device for an internal combustion engine according to claim 7, wherein the high-pressure fuel pump has a spill valve and is configured to change an amount of fuel to be pressure fed by controlling timing to close the spill valve, and the control device maintains the spill valve in an open state, thereby reducing the operation amount of the high-pressure fuel pump.

9. The control device for an internal combustion engine according to claim 7, wherein the control device is provided with a clutch capable of disconnecting the high-pressure fuel pump and the camshaft from each other, and the control device stops an operation of the high-pressure fuel pump by disconnecting the high-pressure fuel pump and the camshaft from each other by means of the clutch, thereby reducing an operation amount of the high-pressure fuel pump.

* * * * *